US007248253B2

(12) United States Patent
Willis

(10) Patent No.: US 7,248,253 B2
(45) Date of Patent: Jul. 24, 2007

(54) PULSE WIDTH MODULATED DISPLAY WITH IMPROVED MOTION APPEARANCE

(75) Inventor: Donald Henry Willis, Indianapolis, IN (US)

(73) Assignee: Thomson Licensing, Boulogne-Billancourt (FR)

( * ) Notice: Subject to any disclaimer, the term of this patent is extended or adjusted under 35 U.S.C. 154(b) by 272 days.

(21) Appl. No.: 10/361,382

(22) Filed: Feb. 10, 2003

(65) Prior Publication Data

US 2004/0041824 A1 Mar. 4, 2004

Related U.S. Application Data

(60) Provisional application No. 60/421,314, filed on Oct. 25, 2002, provisional application No. 60/403,156, filed on Aug. 13, 2002.

(51) Int. Cl.
*G09G 5/00* (2006.01)

(52) U.S. Cl. ..... 345/204

(58) Field of Classification Search ..... 345/204; 359/264, 254; 389/238, 242
See application file for complete search history.

(56) References Cited

U.S. PATENT DOCUMENTS 5,287,096 A * 2/1994 Thompson et al. ..... 345/697
5,774,196 A 6/1998 Marshall
5,986,640 A 11/1999 Baldwin et al. ..... 345/147
6,061,049 A * 5/2000 Pettitt et al. ..... 345/691
6,362,835 B1 3/2002 Urbanus et al.
6,535,187 B1 3/2003 Wood ..... 345/84
6,781,737 B2 * 8/2004 Willis ..... 359/264

OTHER PUBLICATIONS

"Single-Panel DLP Projection System Optics", Application Report,□□DLPA 002-Jun. 2001, Texas Instruments.*
"Single Panel DLP™ Projection System Optics", Application Report DLPA 002-Jun. 2001, Texas Instruments.

(Continued)

*Primary Examiner*—Amr A. Awad
*Assistant Examiner*—Steven Holton
(74) *Attorney, Agent, or Firm*—Joseph J. Laks; Harvey D. Fried

(57) ABSTRACT

A field sequential pulse width modulated display system (10) comprises a digital micromirror device (DMD) (24) having a plurality of micromirrors that each selectively pivot to reflect light onto a screen (28) to illuminate a corresponding pixel. A driver circuit (30) controls the DMD (24) responsive to sequences of pulse width segments formed by a processor (31). The processor (31) forms the pulse width segment sequences to alter the pixel brightness for a given one of a set of primary colors within a range of brightness values between adjacent pixel brightness boundaries, with each segment for each color interleaved with the segments for the other colors. The processor (31) alters the pixel brightness for a given color by altering the state of at least one selected pulse in only a single pulse width segment unless all of the pulses in that segment have the same state (all actuated or de-actuated), whereupon the state of one or more selected pulses in another pulse width segment are altered as the brightness of the pixels change. Any redistribution of light resulting from a change in pixel brightness is limited to the interval corresponding to a single pulse width segment, thereby reducing the likelihood of a visual disturbance perceptible to a viewer.

14 Claims, 6 Drawing Sheets

OTHER PUBLICATIONS

"DLP™ Projection System Digital Image Artifacts" Application Report DLPA 003-Mar. 2001, Texas Instruments.
"High Definition Display System Based on Digital Micromirror Device", Robert J. Grove et al. *International Workshop on HDTV* (Oct. 1994).
"DMD Systems: The Impact of an All-Digital Display" Robert J. Grove, *Society for Information Display International Symposium*, (Jun. 1994).
"Digital Micromirror Display for Projection TV", Michael Mignardi, *Solid State Technology*, vol. 37, pp. 63-66, (Jul. 1994).

* cited by examiner

FIG. 3

| BRIGHTNESS | SEGMENT 1 | SEGMENT 2 | SEGMENT 3 | SEGMENT 4 | SEGMENT 5 | |
|---|---|---|---|---|---|---|
| | 10 1 16 2 8 4 10 | 10 1 16 2 8 4 10 | 8 2 7 15 7 4 7 1 | 10 1 16 2 8 4 10 | 10 1 16 2 8 4 10 | |
| 1 | | | 1 | | | 1 |
| 2 | | | 2 | | | 2 |
| 3 | | | 2 1 | | | 3 |
| 4 | | | 4 | | | 4 |
| 5 | | | 4 1 | | | 5 |
| 6 | | | 2 4 | | | 6 |
| 7 | | | 7 | | | 7 |
| 8 | | | 7 1 | | | 8 |
| 9 | | | 2 7 | | | 9 |
| 10 | | | 2 7 1 | | | 10 |
| 11 | | | 7 4 | | | 11 |
| 12 | | | 7 4 1 | | | 12 |
| 13 | | | 2 7 4 | | | 13 |
| 14 | | | 7 7 | | | 14 |
| 15 | | | 15 | | | 15 |
| 16 | | | 15 1 | | | 16 |
| 17 | | | 2 15 | | | 17 |
| 18 | | | 2 15 1 | | | 18 |
| 19 | | | 15 4 | | | 19 |
| 20 | | | 15 4 1 | | | 20 |
| 21 | | | 2 15 4 | | | 21 |
| 22 | | | 15 7 | | | 22 |
| 23 | | | 15 7 1 | | | 23 |
| 24 | | | 2 15 7 | | | 24 |
| 25 | | | 2 15 7 1 | | | 25 |
| 26 | | | 15 7 4 | | | 26 |
| 27 | | | 15 7 4 1 | | | 27 |
| 28 | | | 2 15 7 4 | | | 28 |
| 29 | | | 7 15 7 | | | 29 |
| 30 | | | 8 15 7 | | | 30 |
| 31 | | | 8 15 7 1 | | | 31 |
| 32 | | | 8 2 15 7 | | | 32 |
| 33 | | | 8 2 15 7 1 | | | 33 |
| 34 | | | 8 15 4 7 | | | 34 |
| 35 | | | 8 15 4 7 1 | | | 35 |
| 36 | | | 8 2 15 4 7 | | | 36 |
| 37 | | | 8 15 7 7 | | | 37 |
| 38 | | | 8 15 7 7 1 | | | 38 |
| 39 | | | 8 2 15 7 7 | | | 39 |
| 40 | | | 8 2 15 7 7 1 | | | 40 |
| 41 | | | 8 15 7 4 7 | | | 41 |
| 42 | | | 8 15 7 4 7 1 | | | 42 |
| 43 | | | 8 2 15 7 4 7 | | | 43 |
| 44 | | | 8 7 15 7 7 | | | 44 |
| 45 | | | 8 7 15 7 7 1 | | | 45 |
| 46 | | | 8 2 7 15 7 7 | | | 46 |
| 47 | | | 8 2 7 15 7 7 1 | | | 47 |
| 48 | | | 8 7 15 7 4 7 | | | 48 |
| 49 | | | 8 7 15 7 4 7 1 | | | 49 |
| 50 | | | 8 2 7 15 7 4 7 | | | 50 |
| 51 | | | 8 2 7 15 7 4 7 1 | | | 51 |

FIG. 4

| BRIGHTNESS | SEGMENT 1 | SEGMENT 2 | SEGMENT 3 | SEGMENT 4 | SEGMENT 5 | |
|---|---|---|---|---|---|---|
| | 10 1 16 2 8 4 10 | 10 1 16 2 8 4 10 | 8 2 7 15 7 4 7 1 | 10 1 16 2 8 4 10 | 10 1 16 2 8 4 10 | |
| 52 | | 1 | 8 2 7 15 7 4 7 1 | | | 52 |
| 53 | | 2 | 8 2 7 15 7 4 7 1 | | | 53 |
| 54 | | 1 2 | 8 2 7 15 7 4 7 1 | | | 54 |
| 55 | | 4 | 8 2 7 15 7 4 7 1 | | | 55 |
| 56 | | 1 4 | 8 2 7 15 7 4 7 1 | | | 56 |
| 57 | | 2 4 | 8 2 7 15 7 4 7 1 | | | 57 |
| 58 | | 1 2 4 | 8 2 7 15 7 4 7 1 | | | 58 |
| 59 | | 8 | 8 2 7 15 7 4 7 1 | | | 59 |
| 60 | | 1 8 | 8 2 7 15 7 4 7 1 | | | 60 |
| 61 | | 2 8 | 8 2 7 15 7 4 7 1 | | | 61 |
| 62 | | 1 2 8 | 8 2 7 15 7 4 7 1 | | | 62 |
| 63 | | 8 4 | 8 2 7 15 7 4 7 1 | | | 63 |
| 64 | | 1 8 4 | 8 2 7 15 7 4 7 1 | | | 64 |
| 65 | | 2 8 4 | 8 2 7 15 7 4 7 1 | | | 65 |
| 66 | | 1 2 8 4 | 8 2 7 15 7 4 7 1 | | | 66 |
| 67 | | 16 | 8 2 7 15 7 4 7 1 | | | 67 |
| 68 | | 1 16 | 8 2 7 15 7 4 7 1 | | | 68 |
| 69 | | 16 2 | 8 2 7 15 7 4 7 1 | | | 69 |
| 70 | | 1 16 2 | 8 2 7 15 7 4 7 1 | | | 70 |
| 71 | | 10 | 8 2 7 15 7 4 7 1 | | | 71 |
| 72 | | 10 1 | 8 2 7 15 7 4 7 1 | | | 72 |
| 73 | | 10 2 | 8 2 7 15 7 4 7 1 | | | 73 |
| 74 | | 10 1 2 | 8 2 7 15 7 4 7 1 | | | 74 |
| 75 | | 10 4 | 8 2 7 15 7 4 7 1 | | | 75 |
| 76 | | 10 1 4 | 8 2 7 15 7 4 7 1 | | | 76 |
| 77 | | 10 2 4 | 8 2 7 15 7 4 7 1 | | | 77 |
| 78 | | 10 1 2 4 | 8 2 7 15 7 4 7 1 | | | 78 |
| 79 | | 10 8 | 8 2 7 15 7 4 7 1 | | | 79 |
| 80 | | 10 1 8 | 8 2 7 15 7 4 7 1 | | | 80 |
| 81 | | 10 2 8 | 8 2 7 15 7 4 7 1 | | | 81 |
| 82 | | 10 1 2 8 | 8 2 7 15 7 4 7 1 | | | 82 |
| 83 | | 10 8 4 | 8 2 7 15 7 4 7 1 | | | 83 |
| 84 | | 10 1 8 4 | 8 2 7 15 7 4 7 1 | | | 84 |
| 85 | | 10 2 8 4 | 8 2 7 15 7 4 7 1 | | | 85 |
| 86 | | 10 1 2 8 4 | 8 2 7 15 7 4 7 1 | | | 86 |
| 87 | | 10 16 | 8 2 7 15 7 4 7 1 | | | 87 |
| 88 | | 10 1 16 | 8 2 7 15 7 4 7 1 | | | 88 |
| 89 | | 10 16 2 | 8 2 7 15 7 4 7 1 | | | 89 |
| 90 | | 10 1 16 2 | 8 2 7 15 7 4 7 1 | | | 90 |
| 91 | | 10 16 4 | 8 2 7 15 7 4 7 1 | | | 91 |
| 92 | | 10 1 16 4 | 8 2 7 15 7 4 7 1 | | | 92 |
| 93 | | 10 16 2 4 | 8 2 7 15 7 4 7 1 | | | 93 |
| 94 | | 10 1 16 2 4 | 8 2 7 15 7 4 7 1 | | | 94 |
| 95 | | 10 16 8 | 8 2 7 15 7 4 7 1 | | | 95 |
| 96 | | 10 1 16 8 | 8 2 7 15 7 4 7 1 | | | 96 |
| 97 | | 10 16 2 8 | 8 2 7 15 7 4 7 1 | | | 97 |
| 98 | | 10 1 16 2 8 | 8 2 7 15 7 4 7 1 | | | 98 |
| 99 | | 10 16 8 4 | 8 2 7 15 7 4 7 1 | | | 99 |
| 100 | | 10 1 16 8 4 | 8 2 7 15 7 4 7 1 | | | 100 |
| 101 | | 10 16 2 8 4 | 8 2 7 15 7 4 7 1 | | | 101 |
| 102 | | 10 1 16 2 8 4 | 8 2 7 15 7 4 7 1 | | | 102 |

FIG. 5

BRIGHTNESS

| | SEGMENT 1 | SEGMENT 2 | SEGMENT 3 | SEGMENT 4 | SEGMENT 5 | |
|---|---|---|---|---|---|---|
| | 10 1 16 2 8 4 10 | 10 1 16 2 8 4 10 | 8 2 7 15 7 4 7 1 | 10 1 16 2 8 4 10 | 10 1 16 2 8 4 10 | |
| 103 | | 10 1 16 2 8 4 10 | 8 2 7 15 7 4 7 1 | 1 | | 103 |
| 104 | | 10 1 16 2 8 4 10 | 8 2 7 15 7 4 7 1 | 2 | | 104 |
| 105 | | 10 1 16 2 8 4 10 | 8 2 7 15 7 4 7 1 | 1 2 | | 105 |
| 106 | | 10 1 16 2 8 4 10 | 8 2 7 15 7 4 7 1 | 4 | | 106 |
| 107 | | 10 1 16 2 8 4 10 | 8 2 7 15 7 4 7 1 | 1 4 | | 107 |
| 108 | | 10 1 16 2 8 4 10 | 8 2 7 15 7 4 7 1 | 2 4 | | 108 |
| 109 | | 10 1 16 2 8 4 10 | 8 2 7 15 7 4 7 1 | 1 2 4 | | 109 |
| 110 | | 10 1 16 2 8 4 10 | 8 2 7 15 7 4 7 1 | 8 | | 110 |
| 111 | | 10 1 16 2 8 4 10 | 8 2 7 15 7 4 7 1 | 1 8 | | 111 |
| 112 | | 10 1 16 2 8 4 10 | 8 2 7 15 7 4 7 1 | 2 8 | | 112 |
| 113 | | 10 1 16 2 8 4 10 | 8 2 7 15 7 4 7 1 | 1 2 8 | | 113 |
| 114 | | 10 1 16 2 8 4 10 | 8 2 7 15 7 4 7 1 | 8 4 | | 114 |
| 115 | | 10 1 16 2 8 4 10 | 8 2 7 15 7 4 7 1 | 1 8 4 | | 115 |
| 116 | | 10 1 16 2 8 4 10 | 8 2 7 15 7 4 7 1 | 2 8 4 | | 116 |
| 117 | | 10 1 16 2 8 4 10 | 8 2 7 15 7 4 7 1 | 1 2 8 4 | | 117 |
| 118 | | 10 1 16 2 8 4 10 | 8 2 7 15 7 4 7 1 | 15 | | 118 |
| 119 | | 10 1 16 2 8 4 10 | 8 2 7 15 7 4 7 1 | 1 16 | | 119 |
| 120 | | 10 1 16 2 8 4 10 | 8 2 7 15 7 4 7 1 | 16 2 | | 120 |
| 121 | | 10 1 16 2 8 4 10 | 8 2 7 15 7 4 7 1 | 1 16 2 | | 121 |
| 122 | | 10 1 16 2 8 4 10 | 8 2 7 15 7 4 7 1 | 10 10 | | 122 |
| 123 | | 10 1 16 2 8 4 10 | 8 2 7 15 7 4 7 1 | 10 1 10 | | 123 |
| 124 | | 10 1 16 2 8 4 10 | 8 2 7 15 7 4 7 1 | 10 2 10 | | 124 |
| 125 | | 10 1 16 2 8 4 10 | 8 2 7 15 7 4 7 1 | 10 1 2 10 | | 125 |
| 126 | | 10 1 16 2 8 4 10 | 8 2 7 15 7 4 7 1 | 10 4 10 | | 126 |
| 127 | | 10 1 16 2 8 4 10 | 8 2 7 15 7 4 7 1 | 10 1 4 10 | | 127 |
| 128 | | 10 1 16 2 8 4 10 | 8 2 7 15 7 4 7 1 | 10 2 4 10 | | 128 |
| 129 | | 10 1 16 2 8 4 10 | 8 2 7 15 7 4 7 1 | 10 1 2 4 10 | | 129 |
| 130 | | 10 1 16 2 8 4 10 | 8 2 7 15 7 4 7 1 | 10 8 10 | | 130 |
| 131 | | 10 1 16 2 8 4 10 | 8 2 7 15 7 4 7 1 | 10 1 8 10 | | 131 |
| 132 | | 10 1 16 2 8 4 10 | 8 2 7 15 7 4 7 1 | 10 2 8 10 | | 132 |
| 133 | | 10 1 16 2 8 4 10 | 8 2 7 15 7 4 7 1 | 10 1 2 8 10 | | 133 |
| 134 | | 10 1 16 2 8 4 10 | 8 2 7 15 7 4 7 1 | 10 8 4 10 | | 134 |
| 135 | | 10 1 16 2 8 4 10 | 8 2 7 15 7 4 7 1 | 10 1 8 4 10 | | 135 |
| 136 | | 10 1 16 2 8 4 10 | 8 2 7 15 7 4 7 1 | 10 2 8 4 10 | | 136 |
| 137 | | 10 1 16 2 8 4 10 | 8 2 7 15 7 4 7 1 | 10 1 16 2 8 4 10 | | 137 |
| 138 | | 10 1 16 2 8 4 10 | 8 2 7 15 7 4 7 1 | 10 16 10 | | 138 |
| 139 | | 10 1 16 2 8 4 10 | 8 2 7 15 7 4 7 1 | 10 1 16 10 | | 139 |
| 140 | | 10 1 16 2 8 4 10 | 8 2 7 15 7 4 7 1 | 10 16 2 10 | | 140 |
| 141 | | 10 1 16 2 8 4 10 | 8 2 7 15 7 4 7 1 | 10 1 16 2 10 | | 141 |
| 142 | | 10 1 16 2 8 4 10 | 8 2 7 15 7 4 7 1 | 10 16 8 10 | | 142 |
| 143 | | 10 1 16 2 8 4 10 | 8 2 7 15 7 4 7 1 | 10 1 16 8 10 | | 143 |
| 144 | | 10 1 16 2 8 4 10 | 8 2 7 15 7 4 7 1 | 10 16 2 8 10 | | 144 |
| 145 | | 10 1 16 2 8 4 10 | 8 2 7 15 7 4 7 1 | 10 1 16 2 8 10 | | 145 |
| 146 | | 10 1 16 2 8 4 10 | 8 2 7 15 7 4 7 1 | 10 16 8 10 | | 146 |
| 147 | | 10 1 16 2 8 4 10 | 8 2 7 15 7 4 7 1 | 10 1 16 8 10 | | 147 |
| 148 | | 10 1 16 2 8 4 10 | 8 2 7 15 7 4 7 1 | 10 16 2 8 10 | | 148 |
| 149 | | 10 1 16 2 8 4 10 | 8 2 7 15 7 4 7 1 | 10 1 16 2 8 10 | | 149 |
| 150 | | 10 1 16 2 8 4 10 | 8 2 7 15 7 4 7 1 | 10 16 8 8 10 | | 150 |
| 151 | | 10 1 16 2 8 4 10 | 8 2 7 15 7 4 7 1 | 10 1 16 8 8 10 | | 151 |
| 152 | | 10 1 16 2 8 4 10 | 8 2 7 15 7 4 7 1 | 10 16 2 8 8 10 | | 152 |
| 153 | | 10 1 16 2 8 4 10 | 8 2 7 15 7 4 7 1 | 10 1 16 2 8 8 10 | | 153 |

FIG. 6

BRIGHTNESS

| | SEGMENT 1 | SEGMENT 2 | SEGMENT 3 | SEGMENT 4 | SEGMENT 5 | |
|---|---|---|---|---|---|---|
| | 10 1 16 2 8 4 10 | 10 1 16 2 8 4 10 | 8 2 7 15 7 4 7 1 | 10 1 16 2 8 4 10 | 10 1 16 2 8 4 10 | |
| 154 | 1 | 10 1 16 2 8 4 10 | 8 2 7 15 7 4 7 1 | 10 1 16 2 8 4 10 | | 154 |
| 155 | 2 | 10 1 16 2 8 4 10 | 8 2 7 15 7 4 7 1 | 10 1 16 2 8 4 10 | | 155 |
| 156 | 1 2 | 10 1 16 2 8 4 10 | 8 2 7 15 7 4 7 1 | 10 1 16 2 8 4 10 | | 156 |
| 157 | 4 | 10 1 16 2 8 4 10 | 8 2 7 15 7 4 7 1 | 10 1 16 2 8 4 10 | | 157 |
| 158 | 1 4 | 10 1 16 2 8 4 10 | 8 2 7 15 7 4 7 1 | 10 1 16 2 8 4 10 | | 158 |
| 159 | 2 4 | 10 1 16 2 8 4 10 | 8 2 7 15 7 4 7 1 | 10 1 16 2 8 4 10 | | 159 |
| 160 | 1 2 4 | 10 1 16 2 8 4 10 | 8 2 7 15 7 4 7 1 | 10 1 16 2 8 4 10 | | 160 |
| 161 | 8 | 10 1 16 2 8 4 10 | 8 2 7 15 7 4 7 1 | 10 1 16 2 8 4 10 | | 161 |
| 162 | 1 8 | 10 1 16 2 8 4 10 | 8 2 7 15 7 4 7 1 | 10 1 16 2 8 4 10 | | 162 |
| 163 | 2 8 | 10 1 16 2 8 4 10 | 8 2 7 15 7 4 7 1 | 10 1 16 2 8 4 10 | | 163 |
| 164 | 1 2 8 | 10 1 16 2 8 4 10 | 8 2 7 15 7 4 7 1 | 10 1 16 2 8 4 10 | | 164 |
| 165 | 8 4 | 10 1 16 2 8 4 10 | 8 2 7 15 7 4 7 1 | 10 1 16 2 8 4 10 | | 165 |
| 166 | 1 8 4 | 10 1 16 2 8 4 10 | 8 2 7 15 7 4 7 1 | 10 1 16 2 8 4 10 | | 166 |
| 167 | 2 8 4 | 10 1 16 2 8 4 10 | 8 2 7 15 7 4 7 1 | 10 1 16 2 8 4 10 | | 167 |
| 168 | 1 2 8 4 | 10 1 16 2 8 4 10 | 8 2 7 15 7 4 7 1 | 10 1 16 2 8 4 10 | | 168 |
| 169 | 16 | 10 1 16 2 8 4 10 | 8 2 7 15 7 4 7 1 | 10 1 16 2 8 4 10 | | 169 |
| 170 | 1 16 | 10 1 16 2 8 4 10 | 8 2 7 15 7 4 7 1 | 10 1 16 2 8 4 10 | | 170 |
| 171 | 16 2 | 10 1 16 2 8 4 10 | 8 2 7 15 7 4 7 1 | 10 1 16 2 8 4 10 | | 171 |
| 172 | 1 16 2 | 10 1 16 2 8 4 10 | 8 2 7 15 7 4 7 1 | 10 1 16 2 8 4 10 | | 172 |
| 173 | 10 | 10 1 16 2 8 4 10 | 8 2 7 15 7 4 7 1 | 10 1 16 2 8 4 10 | | 173 |
| 174 | 10 1 | 10 1 16 2 8 4 10 | 8 2 7 15 7 4 7 1 | 10 1 16 2 8 4 10 | | 174 |
| 175 | 10 2 | 10 1 16 2 8 4 10 | 8 2 7 15 7 4 7 1 | 10 1 16 2 8 4 10 | | 175 |
| 176 | 10 1 2 | 10 1 16 2 8 4 10 | 8 2 7 15 7 4 7 1 | 10 1 16 2 8 4 10 | | 176 |
| 177 | 10 4 10 | 10 1 16 2 8 4 10 | 8 2 7 15 7 4 7 1 | 10 1 16 2 8 4 10 | | 177 |
| 178 | 10 1 4 10 | 10 1 16 2 8 4 10 | 8 2 7 15 7 4 7 1 | 10 1 16 2 8 4 10 | | 178 |
| 179 | 10 2 4 10 | 10 1 16 2 8 4 10 | 8 2 7 15 7 4 7 1 | 10 1 16 2 8 4 10 | | 179 |
| 180 | 10 1 2 4 10 | 10 1 16 2 8 4 10 | 8 2 7 15 7 4 7 1 | 10 1 16 2 8 4 10 | | 180 |
| 181 | 10 8 10 | 10 1 16 2 8 4 10 | 8 2 7 15 7 4 7 1 | 10 1 16 2 8 4 10 | | 181 |
| 182 | 10 1 8 10 | 10 1 16 2 8 4 10 | 8 2 7 15 7 4 7 1 | 10 1 16 2 8 4 10 | | 182 |
| 183 | 10 2 8 10 | 10 1 16 2 8 4 10 | 8 2 7 15 7 4 7 1 | 10 1 16 2 8 4 10 | | 183 |
| 184 | 10 1 2 8 10 | 10 1 16 2 8 4 10 | 8 2 7 15 7 4 7 1 | 10 1 16 2 8 4 10 | | 184 |
| 185 | 10 8 4 10 | 10 1 16 2 8 4 10 | 8 2 7 15 7 4 7 1 | 10 1 16 2 8 4 10 | | 185 |
| 186 | 10 1 8 4 10 | 10 1 16 2 8 4 10 | 8 2 7 15 7 4 7 1 | 10 1 16 2 8 4 10 | | 186 |
| 187 | 10 2 8 4 10 | 10 1 16 2 8 4 10 | 8 2 7 15 7 4 7 1 | 10 1 16 2 8 4 10 | | 187 |
| 188 | 10 1 2 8 4 10 | 10 1 16 2 8 4 10 | 8 2 7 15 7 4 7 1 | 10 1 16 2 8 4 10 | | 188 |
| 189 | 10 16 10 | 10 1 16 2 8 4 10 | 8 2 7 15 7 4 7 1 | 10 1 16 2 8 4 10 | | 189 |
| 190 | 10 1 16 10 | 10 1 16 2 8 4 10 | 8 2 7 15 7 4 7 1 | 10 1 16 2 8 4 10 | | 190 |
| 191 | 10 16 2 10 | 10 1 16 2 8 4 10 | 8 2 7 15 7 4 7 1 | 10 1 16 2 8 4 10 | | 191 |
| 192 | 10 1 16 2 10 | 10 1 16 2 8 4 10 | 8 2 7 15 7 4 7 1 | 10 1 16 2 8 4 10 | | 192 |
| 193 | 10 16 4 10 | 10 1 16 2 8 4 10 | 8 2 7 15 7 4 7 1 | 10 1 16 2 8 4 10 | | 193 |
| 194 | 10 1 16 4 10 | 10 1 16 2 8 4 10 | 8 2 7 15 7 4 7 1 | 10 1 16 2 8 4 10 | | 194 |
| 195 | 10 16 2 4 10 | 10 1 16 2 8 4 10 | 8 2 7 15 7 4 7 1 | 10 1 16 2 8 4 10 | | 195 |
| 196 | 10 1 16 2 4 10 | 10 1 16 2 8 4 10 | 8 2 7 15 7 4 7 1 | 10 1 16 2 8 4 10 | | 196 |
| 197 | 10 16 8 10 | 10 1 16 2 8 4 10 | 8 2 7 15 7 4 7 1 | 10 1 16 2 8 4 10 | | 197 |
| 198 | 10 1 16 8 10 | 10 1 16 2 8 4 10 | 8 2 7 15 7 4 7 1 | 10 1 16 2 8 4 10 | | 198 |
| 199 | 10 16 2 8 10 | 10 1 16 2 8 4 10 | 8 2 7 15 7 4 7 1 | 10 1 16 2 8 4 10 | | 199 |
| 200 | 10 1 16 2 8 10 | 10 1 16 2 8 4 10 | 8 2 7 15 7 4 7 1 | 10 1 16 2 8 4 10 | | 200 |
| 201 | 10 16 8 4 10 | 10 1 16 2 8 4 10 | 8 2 7 15 7 4 7 1 | 10 1 16 2 8 4 10 | | 201 |
| 202 | 10 1 16 8 4 10 | 10 1 16 2 8 4 10 | 8 2 7 15 7 4 7 1 | 10 1 16 2 8 4 10 | | 202 |
| 203 | 10 16 2 8 4 10 | 10 1 16 2 8 4 10 | 8 2 7 15 7 4 7 1 | 10 1 16 2 8 4 10 | | 203 |
| 204 | 10 1 16 2 8 4 10 | 10 1 16 2 8 4 10 | 8 2 7 15 7 4 7 1 | 10 1 16 2 8 4 10 | | 204 |

FIG. 7

BRIGHTNESS

| | SEGMENT 1 | SEGMENT 2 | SEGMENT 3 | SEGMENT 4 | SEGMENT 5 | |
|---|---|---|---|---|---|---|
| | 10 1 16 2 8 4 10 | 10 1 16 2 8 4 10 | 8 2 7 15 7 4 7 1 | 10 1 16 2 8 4 10 | 10 1 16 2 8 4 10 | |
| 205 | 10 1 16 2 8 4 10 | 10 1 16 2 8 4 10 | 8 2 7 15 7 4 7 1 | 10 1 16 2 8 4 10 | 1 | 205 |
| 206 | 10 1 16 2 8 4 10 | 10 1 16 2 8 4 10 | 8 2 7 15 7 4 7 1 | 10 1 16 2 8 4 10 | 2 | 206 |
| 207 | 10 1 16 2 8 4 10 | 10 1 16 2 8 4 10 | 8 2 7 15 7 4 7 1 | 10 1 16 2 8 4 10 | 1 2 | 207 |
| 208 | 10 1 16 2 8 4 10 | 10 1 16 2 8 4 10 | 8 2 7 15 7 4 7 1 | 10 1 16 2 8 4 10 | 4 | 208 |
| 209 | 10 1 16 2 8 4 10 | 10 1 16 2 8 4 10 | 8 2 7 15 7 4 7 1 | 10 1 16 2 8 4 10 | 1 4 | 209 |
| 210 | 10 1 16 2 8 4 10 | 10 1 16 2 8 4 10 | 8 2 7 15 7 4 7 1 | 10 1 16 2 8 4 10 | 2 4 | 210 |
| 211 | 10 1 16 2 8 4 10 | 10 1 16 2 8 4 10 | 8 2 7 15 7 4 7 1 | 10 1 16 2 8 4 10 | 1 2 4 | 211 |
| 212 | 10 1 16 2 8 4 10 | 10 1 16 2 8 4 10 | 8 2 7 15 7 4 7 1 | 10 1 16 2 8 4 10 | 8 | 212 |
| 213 | 10 1 16 2 8 4 10 | 10 1 16 2 8 4 10 | 8 2 7 15 7 4 7 1 | 10 1 16 2 8 4 10 | 1 8 | 213 |
| 214 | 10 1 16 2 8 4 10 | 10 1 16 2 8 4 10 | 8 2 7 15 7 4 7 1 | 10 1 16 2 8 4 10 | 2 8 | 214 |
| 215 | 10 1 16 2 8 4 10 | 10 1 16 2 8 4 10 | 8 2 7 15 7 4 7 1 | 10 1 16 2 8 4 10 | 1 2 8 | 215 |
| 216 | 10 1 16 2 8 4 10 | 10 1 16 2 8 4 10 | 8 2 7 15 7 4 7 1 | 10 1 16 2 8 4 10 | 8 4 | 216 |
| 217 | 10 1 16 2 8 4 10 | 10 1 16 2 8 4 10 | 8 2 7 15 7 4 7 1 | 10 1 16 2 8 4 10 | 1 8 4 | 217 |
| 218 | 10 1 16 2 8 4 10 | 10 1 16 2 8 4 10 | 8 2 7 15 7 4 7 1 | 10 1 16 2 8 4 10 | 2 8 4 | 218 |
| 219 | 10 1 16 2 8 4 10 | 10 1 16 2 8 4 10 | 8 2 7 15 7 4 7 1 | 10 1 16 2 8 4 10 | 1 2 8 4 | 219 |
| 220 | 10 1 16 2 8 4 10 | 10 1 16 2 8 4 10 | 8 2 7 15 7 4 7 1 | 10 1 16 2 8 4 10 | 16 | 220 |
| 221 | 10 1 16 2 8 4 10 | 10 1 16 2 8 4 10 | 8 2 7 15 7 4 7 1 | 10 1 16 2 8 4 10 | 1 16 | 221 |
| 222 | 10 1 16 2 8 4 10 | 10 1 16 2 8 4 10 | 8 2 7 15 7 4 7 1 | 10 1 16 2 8 4 10 | 16 2 | 222 |
| 223 | 10 1 16 2 8 4 10 | 10 1 16 2 8 4 10 | 8 2 7 15 7 4 7 1 | 10 1 16 2 8 4 10 | 1 16 2 | 223 |
| 224 | 10 1 16 2 8 4 10 | 10 1 16 2 8 4 10 | 8 2 7 15 7 4 7 1 | 10 1 16 2 8 4 10 | 10 10 | 224 |
| 225 | 10 1 16 2 8 4 10 | 10 1 16 2 8 4 10 | 8 2 7 15 7 4 7 1 | 10 1 16 2 8 4 10 | 10 1 10 | 225 |
| 226 | 10 1 16 2 8 4 10 | 10 1 16 2 8 4 10 | 8 2 7 15 7 4 7 1 | 10 1 16 2 8 4 10 | 10 2 10 | 226 |
| 227 | 10 1 16 2 8 4 10 | 10 1 16 2 8 4 10 | 8 2 7 15 7 4 7 1 | 10 1 16 2 8 4 10 | 10 1 2 10 | 227 |
| 228 | 10 1 16 2 8 4 10 | 10 1 16 2 8 4 10 | 8 2 7 15 7 4 7 1 | 10 1 16 2 8 4 10 | 10 4 10 | 228 |
| 229 | 10 1 16 2 8 4 10 | 10 1 16 2 8 4 10 | 8 2 7 15 7 4 7 1 | 10 1 16 2 8 4 10 | 10 1 4 10 | 229 |
| 230 | 10 1 16 2 8 4 10 | 10 1 16 2 8 4 10 | 8 2 7 15 7 4 7 1 | 10 1 16 2 8 4 10 | 10 2 4 10 | 230 |
| 231 | 10 1 16 2 8 4 10 | 10 1 16 2 8 4 10 | 8 2 7 15 7 4 7 1 | 10 1 16 2 8 4 10 | 10 1 2 4 10 | 231 |
| 232 | 10 1 16 2 8 4 10 | 10 1 16 2 8 4 10 | 8 2 7 15 7 4 7 1 | 10 1 16 2 8 4 10 | 10 8 10 | 232 |
| 233 | 10 1 16 2 8 4 10 | 10 1 16 2 8 4 10 | 8 2 7 15 7 4 7 1 | 10 1 16 2 8 4 10 | 10 1 8 10 | 233 |
| 234 | 10 1 16 2 8 4 10 | 10 1 16 2 8 4 10 | 8 2 7 15 7 4 7 1 | 10 1 16 2 8 4 10 | 10 2 8 10 | 234 |
| 235 | 10 1 16 2 8 4 10 | 10 1 16 2 8 4 10 | 8 2 7 15 7 4 7 1 | 10 1 16 2 8 4 10 | 10 1 2 8 10 | 235 |
| 236 | 10 1 16 2 8 4 10 | 10 1 16 2 8 4 10 | 8 2 7 15 7 4 7 1 | 10 1 16 2 8 4 10 | 10 8 4 10 | 236 |
| 237 | 10 1 16 2 8 4 10 | 10 1 16 2 8 4 10 | 8 2 7 15 7 4 7 1 | 10 1 16 2 8 4 10 | 10 1 8 4 10 | 237 |
| 238 | 10 1 16 2 8 4 10 | 10 1 16 2 8 4 10 | 8 2 7 15 7 4 7 1 | 10 1 16 2 8 4 10 | 10 2 8 4 10 | 238 |
| 239 | 10 1 16 2 8 4 10 | 10 1 16 2 8 4 10 | 8 2 7 15 7 4 7 1 | 10 1 16 2 8 4 10 | 10 1 2 8 4 10 | 239 |
| 240 | 10 1 16 2 8 4 10 | 10 1 16 2 8 4 10 | 8 2 7 15 7 4 7 1 | 10 1 16 2 8 4 10 | 10 16 10 | 240 |
| 241 | 10 1 16 2 8 4 10 | 10 1 16 2 8 4 10 | 8 2 7 15 7 4 7 1 | 10 1 16 2 8 4 10 | 10 1 16 10 | 241 |
| 242 | 10 1 16 2 8 4 10 | 10 1 16 2 8 4 10 | 8 2 7 15 7 4 7 1 | 10 1 16 2 8 4 10 | 10 16 2 10 | 242 |
| 243 | 10 1 16 2 8 4 10 | 10 1 16 2 8 4 10 | 8 2 7 15 7 4 7 1 | 10 1 16 2 8 4 10 | 10 1 16 2 10 | 243 |
| 244 | 10 1 16 2 8 4 10 | 10 1 16 2 8 4 10 | 8 2 7 15 7 4 7 1 | 10 1 16 2 8 4 10 | 10 16 4 10 | 244 |
| 245 | 10 1 16 2 8 4 10 | 10 1 16 2 8 4 10 | 8 2 7 15 7 4 7 1 | 10 1 16 2 8 4 10 | 10 1 16 4 10 | 245 |
| 246 | 10 1 16 2 8 4 10 | 10 1 16 2 8 4 10 | 8 2 7 15 7 4 7 1 | 10 1 16 2 8 4 10 | 10 16 2 4 10 | 246 |
| 247 | 10 1 16 2 8 4 10 | 10 1 16 2 8 4 10 | 8 2 7 15 7 4 7 1 | 10 1 16 2 8 4 10 | 10 1 16 2 4 10 | 247 |
| 248 | 10 1 16 2 8 4 10 | 10 1 16 2 8 4 10 | 8 2 7 15 7 4 7 1 | 10 1 16 2 8 4 10 | 10 16 8 10 | 248 |
| 249 | 10 1 16 2 8 4 10 | 10 1 16 2 8 4 10 | 8 2 7 15 7 4 7 1 | 10 1 16 2 8 4 10 | 10 1 16 8 10 | 249 |
| 250 | 10 1 16 2 8 4 10 | 10 1 16 2 8 4 10 | 8 2 7 15 7 4 7 1 | 10 1 16 2 8 4 10 | 10 16 2 8 10 | 250 |
| 251 | 10 1 16 2 8 4 10 | 10 1 16 2 8 4 10 | 8 2 7 15 7 4 7 1 | 10 1 16 2 8 4 10 | 10 1 16 2 8 10 | 251 |
| 252 | 10 1 16 2 8 4 10 | 10 1 16 2 8 4 10 | 8 2 7 15 7 4 7 1 | 10 1 16 2 8 4 10 | 10 16 8 4 10 | 252 |
| 253 | 10 1 16 2 8 4 10 | 10 1 16 2 8 4 10 | 8 2 7 15 7 4 7 1 | 10 1 16 2 8 4 10 | 10 1 16 8 4 10 | 253 |
| 254 | 10 1 16 2 8 4 10 | 10 1 16 2 8 4 10 | 8 2 7 15 7 4 7 1 | 10 1 16 2 8 4 10 | 10 16 2 8 4 10 | 254 |
| 255 | 10 1 16 2 8 4 10 | 10 1 16 2 8 4 10 | 8 2 7 15 7 4 7 1 | 10 1 16 2 8 4 10 | 10 1 16 2 8 4 10 | 255 |

PULSE WIDTH MODULATED DISPLAY WITH IMPROVED MOTION APPEARANCE

CROSS REFERENCE TO RELATED APPLICATION

This application claims priority under 35 U.S.C. 119(e) to U.S. Provisional Patent Application Ser. No. 60/403,156, filed Aug. 13, 2002, and to U.S. Provisional Application Ser. No. 60/421,314, filed Oct. 25, 2002 the teachings of both of which are incorporated herein.

TECHNICAL FIELD

This invention relates to a pulse width modulated light projection system, and more particularly, to a technique for operating a pulse width modulated light projection system to minimize motion artifacts.

BACKGROUND ART

Presently, there exists a type of semiconductor device, known as a Digital Micromirror Device (DMD), comprising a plurality of individually movable micromirrors arranged in a rectangular array. Each micromirror pivots about limited arc, typically on the order of 10–12° under the control of a corresponding driver cell that latches a bit therein. Upon the application of a previously latched "1" bit, the driver cell causes its associated micromirror cell to pivot to a first position. Conversely, the application of a previously latched "0" bit to the driver cell causes the driver cell to pivot its associated micromirror to a second position. By appropriately positioning the DMD between a light source and a projection lens, each individual micromirror of the DMD device, when pivoted by its corresponding driver cell to the first position, will reflect light from the light source through the lens and onto a display screen to illuminate an individual picture element (pixel) in the display. When pivoted to its second position, each micromirror reflects light away from the display screen, causing the corresponding pixel to appear dark. An example of such DMD device is the DMD of the DLP™ projection system available from Texas Instruments, Dallas Tex.

Present day projection systems that incorporate a DMD of the type described above control the brightness (illumination) of the individual pixels by controlling the duty cycle during which the individual micromirrors remain "on" (i.e., pivoted to their first position), versus the interval during which the micromirrors remain "off" (i.e. pivoted to their second position). To that end, such present day DMD-type projection systems use pulse width modulation to control the pixel brightness by varying the duty cycle of each micromirror in accordance with the state of the pulses in a sequence of pulse width segments. Each pulse width segment comprises a string of pulses of different time duration. The state of each pulse in a pulse width segment (i.e., whether each pulse is turned on or off) determines whether the micromirror remains on or off for the duration of that pulse. In other words, the more pulses in a pulse width segment that are turned on, the longer the duty cycle of each micromirror.

In a television projection system utilizing a DMD, the frame interval, i.e., the time between displaying successive images, depends on the selected television standard. The NTSC standard currently in use in the United States requires a frame interval of 1/60 second whereas certain European television standards employ a frame interval of 1/50 second.

Present day DMD-type television projection systems typically achieve a color display by projecting red, green, and blue images either simultaneously or in sequence during each frame interval. A typical sequential DMD-type projection system utilizes a motor-driven color wheel interposed in the light path of the DMD. The color wheel has a plurality of separate primary color windows, typically red, green and blue, so that during successive intervals, red, green, and blue light, respectively, falls on the DMD. To achieve a color picture, red, green and blue light must fall on the DMD at least once within each successive frame interval. If only one red, one green and one blue image is made and each consumes 1/3 of the frame interval, then a time delay will occur between colors which produces perceptible color breakup with motion. Present day DMD systems address this problem by breaking each color into several intervals and interleaving the intervals in time, thereby reducing the delay between colors.

Pulse width modulated projection systems of the type described above that have the ability to make multiple images of each primary color during each frame interval to yield a color picture often suffer from motion artifacts. Motion artifacts occur when a single moving object appears as multiple moving objects, the result of the motion of the viewer's eye trying to follow the single moving object displayed multiple times per frame interval.

Thus, there is a need for a technique for operating a pulse width modulated display to reduce the presence of motion artifacts.

BRIEF SUMMARY OF THE INVENTION

In accordance with present principles, there is provided a method for operating a pulse width modulated display system, such as a pulse width modulated display system that incorporates a Digital Micromirror Device (DMD), to selectively reflect light from a light source through a projection lens and onto a display screen. In such a display system, the illumination of each pixel for each color is controlled responsive to the pulses within each sequence of pulse width segments applied to a driver circuit that drives the DMD device, with the state of each individual pulse in a segment determining the whether the pixel remains illuminated for that color during the interval associated with that pulse. To reduce the occurrence of motion artifacts in accordance with present principles, an increase in pixel brightness for a given color not exceeding a first pixel brightness boundary is achieved by actuating (i.e., turning on) at least one selected pulse within only a single pulse width segment. An increase in pixel brightness above the first brightness boundary but below a second brightness boundary occurs by actuating at least one selected pulse within only a second pulse width segment, with all of the pulses in the first segment that were previously actuated to reach the first pixel brightness boundary remaining actuated. An increase in pixel brightness above the second pixel brightness boundary but below a third pixel brightness boundary is achieved by actuating at least one selected pulse within only a third pulse width segment, with the pulses in the first and second segments that were actuated to reach the second pixel brightness boundary remaining actuated. Thus, an increase in pixel brightness between adjacent pixel brightness boundaries occurs by actuating at least one selected pulse within only a single unfilled pulse width segment (i.e., a pulse width segment whose pulses have not been actuated) unless all of the all of the pulses in that segment are actuated, whereupon one or more selected pulses in a second segment are actuated as the brightness of each of the pixel increases. For each color, a pulse width segment whose pulses become actuated lies adjacent in time to the segment whose pulses have already been actuated. Each pulse width segment for each color lies adjacent in time to a pulse width segment of another color that is lit (i.e., a pulse width segment having one or more actuated segments to illuminate that corresponding color). In other words, for a white pixel, there is no gap between lit color segments.

Conversely, a decrease in pixel brightness to a brightness level not below a first pixel brightness boundary occurs by de-actuating (i.e., turning off) at least one selected pulse within a single pulse width segment. To achieve a decrease in pixel brightness below the first pixel brightness boundary (but not below a second pixel brightness boundary), at least one selected pulse within a second pulse width segment is de-actuated, with the pulses in the first segment remaining all de-actuated. A decrease in pixel brightness below the second pixel brightness boundary but not below a third pixel brightness boundary occurs by de-actuating at least one selected pulse within the third pulse width segment (with the pulses within the first and second segments remaining de-actuated). Thus, a decrease in pixel brightness between adjacent pixel brightness boundaries occurs by selectively de-actuating the pulses within a single pulse width segment unless all pulses in that segment are de-actuated, whereupon the one or more selected pulses in another segment are de-actuated as the brightness of each of the pixels decreases.

BRIEF DESCRIPTION OF THE DRAWINGS

FIGS. 3–7 collectively illustrate a pulse map depicting each of a plurality of sequences of pulse width segments that control the brightness of a corresponding color of one of the pixels within the display system of FIG. 1 to reduce motion artifacts in accordance with the present principles.

DETAILED DESCRIPTION

Figure 1:
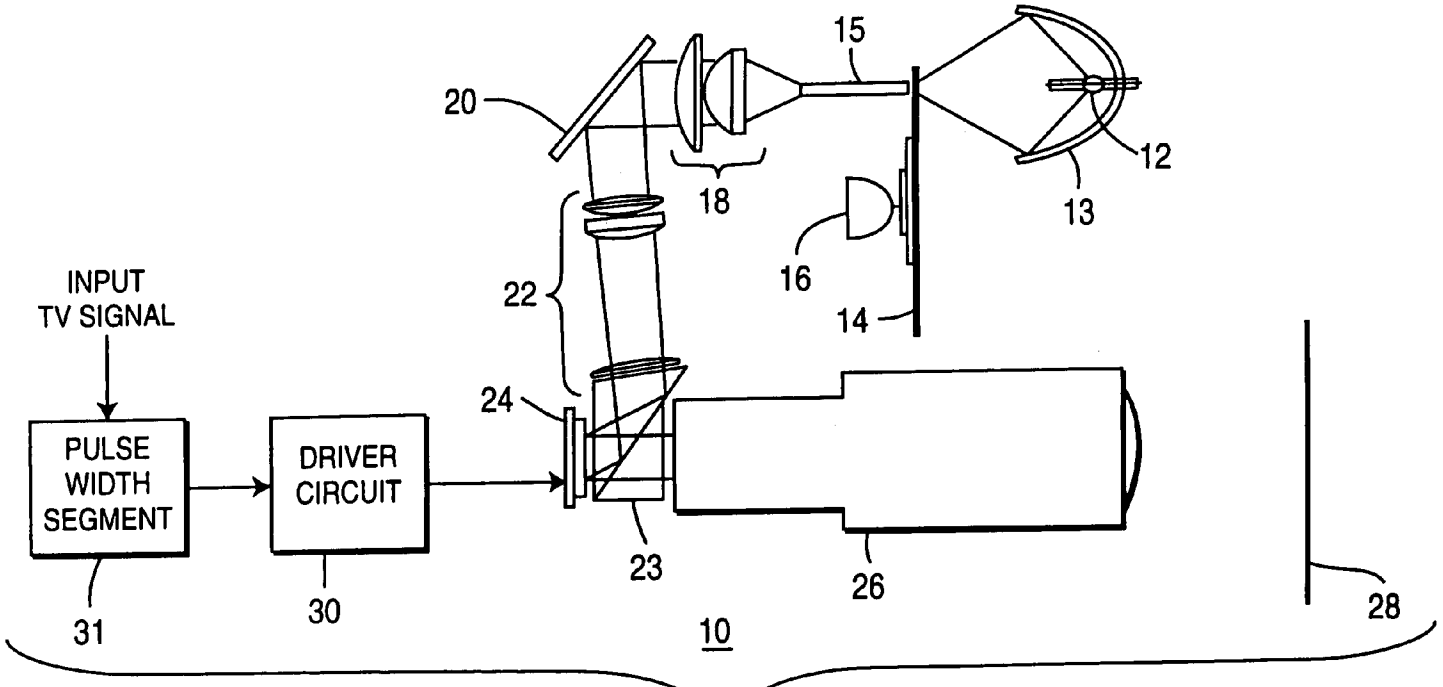
FIG. 1 depicts a block schematic diagram of a present-day pulse width modulated display system.
Figure 2:
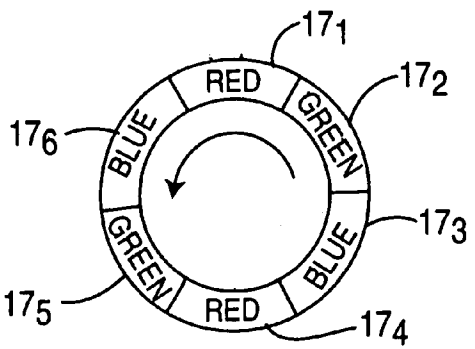
FIG. 2 depicts a frontal view of a color wheel comprising part of the display system of FIG. 1.

FIG. 1 depicts a present-day pulse width modulated display system 10 of the type disclosed in the Application Report "Single Panel DLP™ Projection System Optics" published by Texas Instruments, June 2001 and incorporated by reference herein. The system 10 comprises a lamp 12 situated at the focus of a parabolic reflector 13 that reflects light from the lamp through a color wheel 14 and into an integrator rod 15. A motor 16 rotates the color wheel 14 to place a separate one of red, green and blue primary color windows between the lamp 12 and the integrator rod 15. In an exemplary embodiment depicted in FIG. 2, the color wheel 14 has diametrically opposed red, green and blue color windows $\mathbf{17}_1$, and $\mathbf{17}_4$, $\mathbf{17}_2$ and $\mathbf{17}_5$, and $\mathbf{17}_3$ and $\mathbf{17}_6$, respectively. Thus, as the motor 16 rotates the color wheel 14 of FIG. 2 in a counter-clockwise direction, red, green and blue light will strike the integrator rod 15 of FIG. 1 in an RGBRGB sequence. In practice, the motor 16 rotates the color wheel 14 at a sufficiently high speed so that during a frame interval of a 1/60 second, red, green and blue light each strikes the integrator rod five times, yielding 15 color images within the frame interval.

Referring to FIG. 1, the integrator rod 15 concentrates the light from the lamp 12, as it passes through a successive one of the red, green and blue color windows of the color wheel 14, onto a set of relay optics 18. The relay optics 18 spread the light into a plurality of parallel beams that strike a fold mirror 20, which reflects the beams through a set of lenses 22 and onto a Total Internal Reflectance (TIR) prism 23. The TIR prism 23 reflects the parallel light beams onto a Digital Mirror Device (DMD) 24, such as the DMD device manufactured by Texas Instruments, for selective reflection into a projection lens 26 and onto a screen 28.

The DMD 24 takes the form of a semiconductor device having a plurality of individual mirrors (not shown) arranged in an array. By way of example, the DMD manufactured and sold by Texas Instruments has a micromirror array of 1280 columns by 720 rows, yielding 921,600 pixels in the resultant picture projected onto the screen 28. Other DMDs can have a different arrangement of micromirrors. As discussed previously, each micromirror in the DMD pivots about a limited arc under the control of a corresponding driver cell (not shown) in response to the state of a binary bit previously latched in the driver cell. Each micromirror rotates to one of a first and a second position depending on whether the latched bit applied to the driver cell, is a "1" or a "0", respectively. When pivoted to its first position, each micromirror reflects light into the lens 26 and onto the screen 28 to illuminate a corresponding pixel. While each micromirror remains pivoted to its second position, the corresponding pixel appears dark. The interval during which each micromirror reflects light through the projection lens 26 and onto the screen 28 (the micromirror duty cycle) determines the pixel brightness.

The individual driver cells in the DMD 24 receive drive signals from a driver circuit 30 of a type well known in the art and exemplified by the circuitry described in the paper "High Definition Display System Based on Micromirror Device", R. J. Grove et al. *International Workshop on HDTV* (October 1994) (incorporated by reference herein.). The driver circuit 30 generates the drive signals for the driver cells in the DMD 24 in accordance with sequences of pulse width segments applied to the driver circuit by a processor 31. Each pulse width segment comprises a string of pulses of different time duration, the state of each pulse determining whether the micromirror remains on or off for the duration of that pulse. The shortest possible pulse (i.e., a 1-pulse) that can occur within a pulse width segment (some times referred to as a Least Significant Bit or LSB) typically has a 15-microsecond duration, whereas the larger pulses in the segment each have a duration that is an integer multiple of the LSB interval. In practice, each pulse within a pulse width segment corresponds to a bit within a digital bit stream whose state determines whether the corresponding pulse is turned on or off. A "1" bit represents a pulse that is turned on, whereas a "0" bit represents a pulse that is turned off.

In practice, each pixel has two hundred fifty-six brightness levels (0–255), yielding an 8-bit pixel brightness capability. For each primary color (red, green, and blue), the brightness levels can be divided equally into five pulse width segments, each having a total width of 51 LSBs (765 microseconds). In an illustrative embodiment, the display period for each color comprises 36 pulses distributed over the five-pulse width segments within a given sequence. Table 1 contains exemplary pulse widths for each color.

TABLE I

| Pulse Width Segment | Pulse Widths |
|---|---|
| 1 | 10 1 16 2 8 4 10 |
| 2 | 10 1 16 2 8 4 10 |

TABLE I-continued

| Pulse Width Segment | Pulse Widths |
|---|---|
| 3 | 8 2 7 15 7 4 7 1 |
| 4 | 10 1 16 2 8 4 10 |
| 5 | 10 1 16 2 8 4 10 |

Previously, DMD-type television system typically suffered from the appearance of motion artifacts stemming from the use of multiple pulse width segments to illuminate each pixel for each primary color. Such motion artifacts arise from the spread of light across the intervals corresponding to the different pulse width segments.

In accordance with the present principles, the processor 31 controls the actuation of the pulses within each pulse width segment to confine the changes in pixel brightness for each color within a given brightness range (i.e., between two pixel brightness boundaries) to a single pulse width segment. In this way, the redistribution of light that results from an increase or decrease in pixel brightness for each color occurs within the interval corresponding to that single pulse width segment, thereby reducing the likelihood of a visual disturbance that is perceptible to a viewer. Reducing such visual disturbances reduces the incidence of motion artifacts.

FIGS. 3–6, in combination, depict the pulse width segments sequences generated by the processor 31 of FIG. 1 to control pixel illumination while minimizing motion artifacts. In each of FIGS. 3–6, the terms "Segment 1", "Segment 2", "Segment 3", "Segment 4", and "Segment 5" refer to a corresponding one of the first, second, third, forth, and fifth pulse width segments, respectively, of Table 1 of a pulse width segment sequence for a single primary color (e.g., red, green, or blue). Each primary color occurs as a result of the combination of the five pulse width segments within a sequence of such segments. Since each of the three primary colors must appear within a frame interval, three sequences of five pulse width segments each (fifteen pulse width segments in all) occur during the frame interval. Under some circumstances, it could be preferable to make each primary color from four, rather than five pulse width segments, thus yielding a total of twelve, rather than fifteen, pulse width segments per frame interval.

FIG. 3 illustrates the sequences of pulse width segments, which when applied to the driver circuit 30 of FIG. 1, achieve each of the corresponding pixel brightness levels #1–#77 for a given primary color. As seen in FIG. 3, brightness level #1 occurs by actuating (turning on) the 1-pulse within the Segment 3 with all the other pulses in Segment 3, and the pulses in Segments 1–2 and 4–5 remain de-actuated (turned off.). As discussed in greater detail below, all of the pulses within the Segments 1–2 and 4–5 remain de-actuated below a first pixel brightness boundary (i.e., pixel brightness level #51) in the illustrated embodiment.

Brightness level #2 occurs by actuating the 2-pulse within Segment 3 and de-actuating the 1-pulse in the same segment. All other pulses in Segment 3 remain de-actuated at this brightness level. Brightness level #3 occurs by actuating both the 2-pulse and the 1-pulse with the other pulses remaining de-actuated. Brightness level 4 occurs by actuating the 4-pulse and de-actuating the 2-pulse and 1-pulses. (Again, all of the other pulses in Segment 3 remain de-actuated at this brightness level.) To achieve Brightness level #5, the 1-pulse becomes actuated (turned on) along with the 4-pulse, with the other pulses remaining de-actuated. Brightness level #6 occurs by actuating the 4-pulse, and 2-pulse, with the 1-pulse and the other pulses de-actuated. Brightness level #7 occurs by turning on the 7-pulse (middle) with the 4-pulse and 2-pulse de-actuated, along with the other pulses.

As can be appreciated, increasing the pixel brightness to reach the first pixel brightness boundary (brightness level #51) occurs by actuating one or more selected pulses in a single pulse width segment (e.g., Segment 3) until all of the pulses within that segment are actuated at the first pixel brightness boundary. Only after reaching the first pixel brightness boundary is a selected pulse (e.g., the 1-pulse) in an adjacent pulse width segment (e.g., Segment 2) actuated to reach next brightness level (i.e., brightness level #52). Referring collectively to FIGS. 3 and 4, each of the pixel brightness levels #52–#102 is achieved by actuating one or more selected pulses only in Segment 2, while all of the pulses in Segment 3 remain actuated, until reaching a second pixel brightness boundary (brightness level #102) at which all of the pulses in Segments 2 and 3 become actuated.

Referring to FIG. 4, each of pixel brightness levels #103–#153 lying above the second pixel brightness boundary is reached by actuating one or more selected pulses in a yet unfilled segment (e.g. Segment 4) with all of the pulses in Segments 2 and 3 remaining actuated until a third pixel brightness boundary is reached (i.e., pixel brightness level #153). Referring to FIG. 5, above the third pixel brightness boundary, each of the brightness levels #154–#204 is reached by actuating one or more selected pulses in yet another unfilled pulse width segment (e.g., Segment 1) while all the pulses in Segments 2, 3 and 4 remain actuated until reaching a fourth pixel brightness boundary (pixel brightness level #204). Referring collectively to FIGS. 5 and 6, above the fourth pixel brightness boundary, each of the brightness levels #205–#255 is reached by actuating one or more selected pulses in yet another unfilled pulse width segment (e.g., Segment 5) with all the pulses in Segments 1–4 remaining actuated. At the fifth pixel brightness boundary (i.e., pixel brightness level #255) all of the pulses in all of the segments for that color remain actuated.

Thus, as can be appreciated from the above discussion, to increase the pixel brightness between two adjacent pixel brightness boundaries, one or more selected pulses in a single, yet unfilled pulse width segment are actuated unless all of the pulses in that segment are actuated, whereupon one or more selected pulses are actuated in a time-adjacent pulse width segment whose pulses are not already actuated. By the same token, between a pair of adjacent pixel boundaries, the pixel brightness is decreased by de-actuating one or more selected pulses in a single pulse width segment unless all the pulses within that pulse width segment are de-actuated, whereupon one or more previously actuated pulses in another time-adjacent pulse width segment are de-actuated. More generally, between adjacent pixel brightness boundaries, the pixel brightness is altered (i.e., increased or decreased) by adjusting (actuating or de-actuating) at least one selected pulse in a single pulse width segment unless all of the pulses in that segment have the same state (all actuated or de-actuated), whereupon the state of the pulses in another time-adjacent pulse width segment are altered (actuated or de-actuated) as the brightness of the pixels change. Confining the change in the state of the pulses within a single pulse width segment to alter the pixel brightness between two adjacent pixel brightness boundaries values reduces the likelihood of a visual disturbance, thereby minimizing motion artifacts.

As discussed above, each pulse width segment within each sequence depicted in FIGS. 3–6 corresponds to a separate one of the several (i.e., five) instances during which each primary color can be made on the DMD 24 of FIG. 1. Thus, in the preferred embodiment, with each sequence comprised of five pulse width segments, each primary color is able to be made five times depending on brightness. The pulse width segments that make individual instances of the red green and blue colors follow each other in time sequence to make successive instances of the red green and blue colors on the DMD 24. In other words, the pulse width segments that can make each individual instance of red, green and blue light are interleaved in time.

Preferably, between adjacent pixel brightness boundaries, the pixel brightness is increased by actuating the pulses within only a single pulse width segment (unless all of the pulses in that segment have been actuated). In some instances, upon reaching a pixel brightness boundary, it could become desirable to increase the pixel brightness by actuating one or more selected pulses in each of two time adjacent segments (for the same color) in a substantially equal manner. (It should be understood that a pulse width segment for each of the other two primary colors lies in between two time adjacent segments of the same color.) Thus, for example, upon actuating all of the pulses within Segment 3 to reach pixel brightness level #51, further increases in pixel brightness to reach the next pixel brightness boundary (brightness level #102) could be made by actuating selected pulses in both Segments 2 and 4 of that color, rather than just Segment 3 as seen in FIG. 3. Actuating the pulses in two time adjacent segments (e.g., Segments 2 and 4) does increase the spread of light across more intervals, and would not necessarily be as effective at reducing motion artifacts as compared to actuating the pulses within only a single interval.

The foregoing describes a technique for minimizing motion artifacts in a pulse width modulated display.

The invention claimed is:

1. A pulse width modulated display system comprising:

a light source and a projection lens for focusing incident light onto a screen;

a digital micro-mirror device having a plurality of individual micro-mirrors arranged in an array, each micro-mirror pivotal about an arc in response to receipt of a drive signal applied to a driver cell associated with the micro-mirror to reflect light from the light source into the projection lens and onto the screen to illuminate a picture element (pixel) therein;

a rotating color wheel interposed between the light source and the digital micro-mirror to successively impart each of three primary colors to the light striking the digital micro-mirror device and reflected thereby into the projection lens;

a processor for forming sequences of pulse width segments, each controlling the brightness of a corresponding pixel for each color within a range of pixel brightness values lying between first and second pixel brightness boundaries by adjusting at least one selected pulse only in a first pulse width segment of an associated sequence unless all of the pulses in the first segment have the same state, whereupon the state of the of at least one selected pulse in a second pulse width segment is altered; and a driver circuit responsive to the sequences of pulse width segments formed by the processor for driving the digital micro-mirror device to illuminate the corresponding pixel, wherein each pulse width segment comprises five pulse width segments per color with each pulse width segment for each color interleaved with the segments for the other colors.

2. The system according to claim 1 wherein the processor adjusts the at least one selected pulse by actuating the pulse to increase the pixel brightness.

3. The system according to claim 1 wherein the processor adjusts the at least one selected pulse by de-actuating the pulse to decrease the pixel brightness.

4. A method for displaying video images using a pulse width modulated display system including a color wheel comprising at least one red, at least one green and at least one blue color window, the method comprising the steps of;

associating respective successive portions of each color window with corresponding respective successive equal pulse segments, defining each of said pulse segments by a plurality of time intervals, each time interval comprising a mulitple of one LSB time interval;

allocating drive pulses for pixels of said display system to time intervals of said pulse segments to represent a first range of brightness values for said display;

such that the time interval allocated for displaying a given bit of said brightness values varies between a first time interval and at least a second time interval over said first range of brightness values.

5. The method of claim 4 wherein said given bit is a least significant bit (LSB) and said time interval allocated for displaying said LSB varies between a first time interval and a second time interval, the first and second time intervals occurring within the same pulse segment.

6. The method of claim 4 wherein said drive pulses are first allocated within a first segment until all time intervals of said first segment are associated with drive pulses, then, allocating said drive pulses to a second segment, the second segment different than the first segment.

7. The method of claim 4 wherein said first range of brightness values comprises all possible brightness values for said display.

8. The method of claim 4 wherein said time intervals within a segment vary in duration.

9. The method of claim 6 wherein said first and second segments are adjacent segments.

10. A method for displaying video images using a pulse width modulated display system including a color wheel comprising at least one red, at least one green and at least one blue color window, the method comprising the steps of;

associating respective successive portions of each color window with corresponding respective successive pulse segments, each pulse segment defined by a plurality of time intervals for providing drive pulses to pixels of said display system in synchronization with rotation of said color wheel to display said video images;

distributing said drive pulses with respect to said pulse segments to define a range of brightness values by steps of:

allocating at least one drive pulse to a first pulse segment corresponding to a middle portion of said color window to represent a lowest brightness level;

representing incremental increases in brightness level above said lowest brightness level by allocating additional drive pulses only to said first pulse segment until all said time intervals of said first pulse segment are associated with a drive pulse; and, next, allocating drive pulses to at least a second pulse segment corresponding to a portion of said given color window different than said middle portion, thereby providing a pulse sequence distribution for said system that avoids motion artifacts in said images.

11. A system for displaying video images comprising:

a light source;

an array of pixel elements responsive to drive pulses for illumination by said light source in accordance with brightness values of a video signal;

a color wheel comprising at least one red, at least one green and at least one blue color window interposed between said light source and said array of pixel elements to provide color illumination of said pixel elements;

a processor for associating respective successive portions of each color window with corresponding respective successive pulse segments, said pulse segments comprising sequences of said drive pulses, said sequences defining brightness levels for pixels of said array;

said sequences comprising pulses distributed about a middle one of said successive segments.

12. The system of claim 11 wherein the number of said pulse segments is five.

13. The system of claim 11 wherein each of said plurality of segments comprises a plurality of time intervals.

14. The system of claim 13 wherein said time intervals comprise multiples of one LSB.

* * * * *